US006216411B1

(12) United States Patent
Barnett

(10) Patent No.: US 6,216,411 B1
(45) Date of Patent: Apr. 17, 2001

(54) FRAME WITH ENVIRONMENT RESISTANT MEMBERS

(76) Inventor: Paul Barnett, P.O. Box 389, Theodore, AL (US) 36590

( * ) Notice: Subject to any disclaimer, the term of this patent is extended or adjusted under 35 U.S.C. 154(b) by 0 days.

(21) Appl. No.: 09/187,251

(22) Filed: Nov. 6, 1998

(51) Int. Cl.[7] ..... E04C 2/12
(52) U.S. Cl. ..... 52/656.4
(58) Field of Search ..... 52/730.7, 726.1, 52/726.2, 726.3, 726.4, 169.14, 656.2, 656.4, 656.5, 656.7, 741.3

(56) References Cited

U.S. PATENT DOCUMENTS 114,138 * 4/1871 Hersey ..... 52/726.4
689,387 * 12/1901 Crossland ..... 52/726.4
2,824,342 * 2/1958 Hoyle, Jr. ..... 52/730.7
5,438,812 * 8/1995 Erickson ..... 52/726.4

* cited by examiner

*Primary Examiner*—Michael Safavi

(57) ABSTRACT

A frame for improved moisture, decay and insect resistance includes frame members each possessing a short treated lumber member joined to a longer untreated lumber member so that the length of the overall board achieves a desired length with an acceptable amount of distortion. The untreated member may be treated but the treatment is not so invasive as to impart a high degree of warping. The treated member may have more or less treatment depending on the amount of distortion which is acceptable. Top and bottom boards connect the frame members to form a door frame.

6 Claims, 3 Drawing Sheets

FRAME WITH ENVIRONMENT RESISTANT MEMBERS

BACKGROUND OF INVENTION

1. Field of Invention

The invention relates to framing members. More specifically, the invention relates to framing members which have an environment resistant portion and a less resistant portion.

2. Prior Art

The closest prior art to the present is U.S. Pat. No. 5,661,943 issued to Hagle in 1997. The Hagle patent uses a composite material to provide weather resistance along the bottom of a frame.

This particular technology represents a combination of composite materials with non-composite timbers. This particular combination is well known in the prior art in various settings. The prior art envisions the use, for example, of a relatively expensive composite wood product joined to an inexpensive wood product where only the expensive wood product is to be exposed for view. One example is where carpeted steps have a exposed wooden portion. Under those circumstances an inexpensive type of timber, such as pine is joined to a more expensive end piece, such as oak so that the exposed oak provides the appearance while the inexpensive portion, the pine is covered with carpet.

Similarly it is known in the art to join composites, fiberglass, resins and plastics to frame members either because of the amount of exposure that those portions are exposed to or in order to provide additional protection against the elements.

One of the problems with using those old technologies lies in the fact that they either use two different types of untreated word or use non-timber products, such as composites, which are more expensive.

3. General Discussion of the Invention

1) Frame with Environment Resistant Members

The invention is best described as a method for combining a treated wood product with and untreated wood product so that a relatively stable, non-composite wood product is joined with a less stable wood.

In order to best understand the invention, some background in lumber technology is necessary. Historically treated lumber grossly distorted relative to untreated lumber. This is because the cell structure of the treated lumber is affected by the method of treatment. The degree of distortion in timber is likewise a function of the length of the treated timber.

Historically for finish work and door jams and window jams and related products treated lumber has been less desirable because even a fairly small length of treated lumber will warp disproportionately.

Recent advances in treatment technology have provided for KDAT lumber, or more specifically, kiln dried after treatment lumber.

This so called KDAT process provides for treated lumber which still warps but warps to a significantly lesser degree.

It should be also noted that the reason that timber is used as opposed to composites or plastics or fiberglass has to with the price and the technology used in constructing these types of products.

For example a nail driven into fiberglass has different properties then a nail driven into a piece of wood. Therefore it can often be better to join with staples or nails products which are both wooden as opposed to one which is wooden and one which is some other composite material.

This same argument applies to glues. A product which is timber will absorb the glue whereas a composite material will absorb or react differently with different types of glues.

One purpose of the present invention is to provide for a combination of low warping with treatment technologies along with untreated or very low warping treatment technologies in order to provide a wood product which has as inexpensive a cost as possible while utilizing wood and wood glues without composites and more particularly without composite at the point where the joining occurs.

The technology also allows for the use treated lumber along with composite materials for purposes which will be better understood from a reading of the entire description which describes where composites are used to further minimize the warping present with treated lumber.

It should be noted that the present technology can be used with integrated composite products so that untreated wood, treated wood and composites are all used consistently.

This might be desirable where more control is desired over the treated wood in order to prevent warping or where a smaller amount of composite material is desired in order to save cost but where a longer area of treatment is believed necessary then the area treated with composite.

In addition, the process for making the present invention a significantly less expensive than the process for using composites since all of the steps associated with the milling of composites are eliminated since only wooden are utilized in the present invention.

In the production of timber a well known technology is the joining of various lengths of timber together in order to reduce an extended length.

In a typical assembly line process, this joinder would consist of having timbers of either predetermined or almost random lengths joined in order to produce a timber member of the desired length or within a range of the desired lengths.

This process is typically described by the following steps:

1. Cutting a first lumber member so that a serrated edge providing increased surface area and more than one plane is produced;
2. Cutting a serrated surface on a second lumber member so that the first serrated edge connects functionally to the several planes provided by cutting the first lumber member,
3. Putting a layer of glue at the point where the first lumber member serrated edge could join the second lumber serrated edge;
4. Pressing the first lumber member serrated edge to the second lumber member serrated edge;
5. Allowing the glue to dry.

This technique is often used over an extended length so that ten or twenty lumber member are joined in sequence with a first lumber member connected to a second lumber connected to a third lumber member, etcetera in order to a member of desired length is provided.

The present invention uses this technology so that the end lumber piece on at least one end of a member so constructed is more highly treated lumber member.

The second lumber member which is the more highly treated lumber member would typically be defined as a second member which had warping properties which were unacceptably high in length equal to those of the first lumber member. Hence the joining of several lumber members of equal warping properties would not be covered by this technology and are accepted as old art. However having a first length of lumber of a length which would be greater then the length acceptable if a high warp material was used joined to a shorter second lumber member which the high warp profile would be covered by the broadest claims of the patent.

It is obvious to see an aligning of the first lumber member to the second lumber member is a necessary part in the process steps.

In the prior art the alignment is usually held by utilizing a press having rollers and bars to align the wood to be joined and this technology exists in the prior art.

DETAILED DESCRIPTION OF THE PREFERRED EXEMPLARY EMBODIMENTS

Figure 1A:
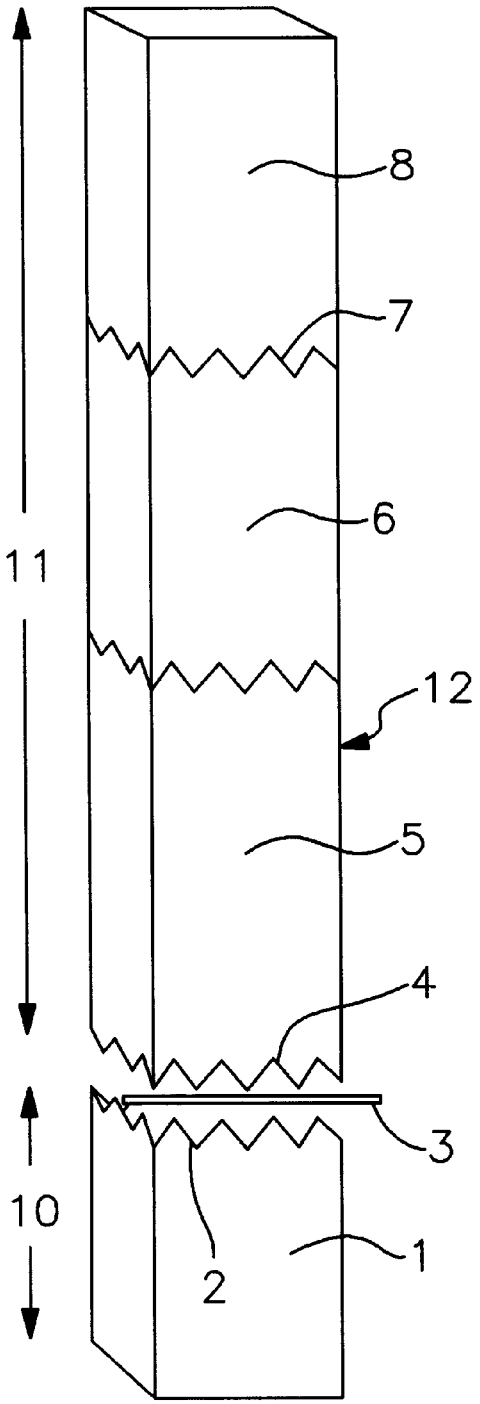
FIG. 1*a* shows a timber being assembled to be used for this process.
Figure 1B:
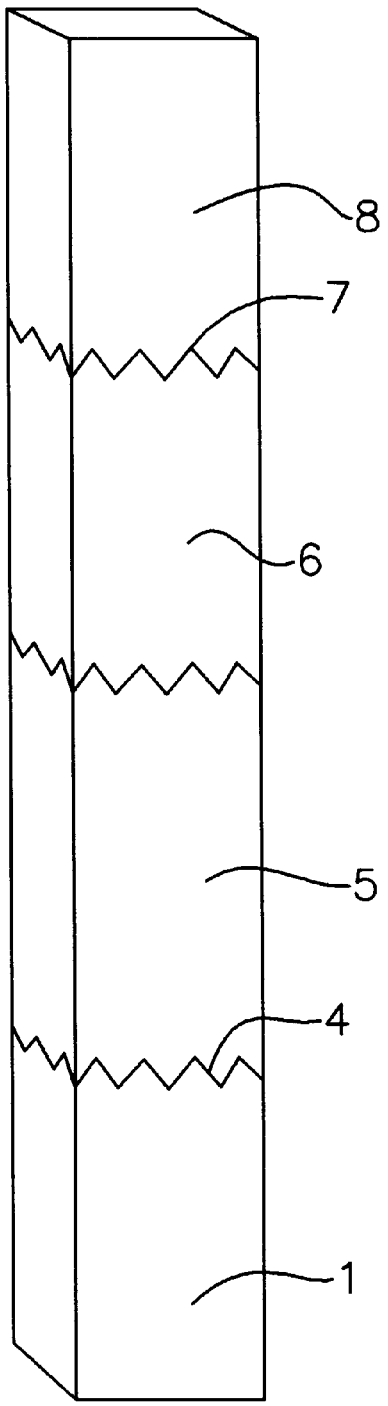
FIG. 1*b* shows the assembled timber shown in FIG. 1*a*.

As can best be seen by FIG. 1*a* the invention comprises a first lumber member 1 (which may itself be made of several different lengths of lumber joined) having a serrated edge 2 which is joined by glue 3 to a corresponding serrated edge 4 of a second lumber member 5 in order to form a continuous unit. The glue line made of glue 3 is shown in an exaggerated size for reference purposes only. The quantity of size of the glue line formed by the glue is governed by the amount of glue desired for this type of joining process and is typically a very thin line, most of the glue being forced out of the interface of the corresponding serrated edges by the hydraulic press which pushes the first lumber member 1 into the second lumber member 5. FIG. 1*b* shows the joined edge 9 of the members 1 and 5. First lumber member is a KDAT treated or otherwise treated member which has a length defined by the parameters of the ultimate use and quality control standards requiring the treated first lumber member 1 to have minimal distortion.

The first lumber member 1 has a length 10. The lumber members above the treated lumber are shown in FIG. 1*a* as being a uniform board length 12. This uniform board length 12 may, and usually would be, entirely constructed of untreated lumber. Untreated lumber is defined as lumber which, if treated at all, is treated with a material which does not cause extensive distortion.

It is possible that the uniform board length 12 could be have treated members within it as long as those treated members were sufficiently short in length to prevent, when incorporated into the unit, unacceptable distortion. For example, as shown in FIG. 1*a*, the top board length 8 could be treated and could be joined by way of a joined edge 7 to untreated members 5 and 6.

The board length 12 has a length 11. The lengths 11 and 10 are defined as a function of the amount of warp expected in each of the two respective lumber members so that the amount of warp of the first lumber member length does not exceed the acceptable warp expected for quality control purposes for a member of that length and the length of the second lumber member does not exceed the acceptable amount of warp for quality control purposes of the second lumber member of desired length.

The first lumber member 1 has a greater degree of warp then the board length 12. Further the first lumber member 1 is resistant to water, insects and other environmental pressures as a result of being treated. The resistance of the first lumber member must be significantly better than the resistance of the second lumber member.

The glue 3 is a type one waterproof glue in the preferred embodiment. Even the untreated units are joined utilizing a pressure and glue process which is known in the art for joining lumber section.

Other joining means are possible other than glue to accomplish the similar result.

Figure 2:
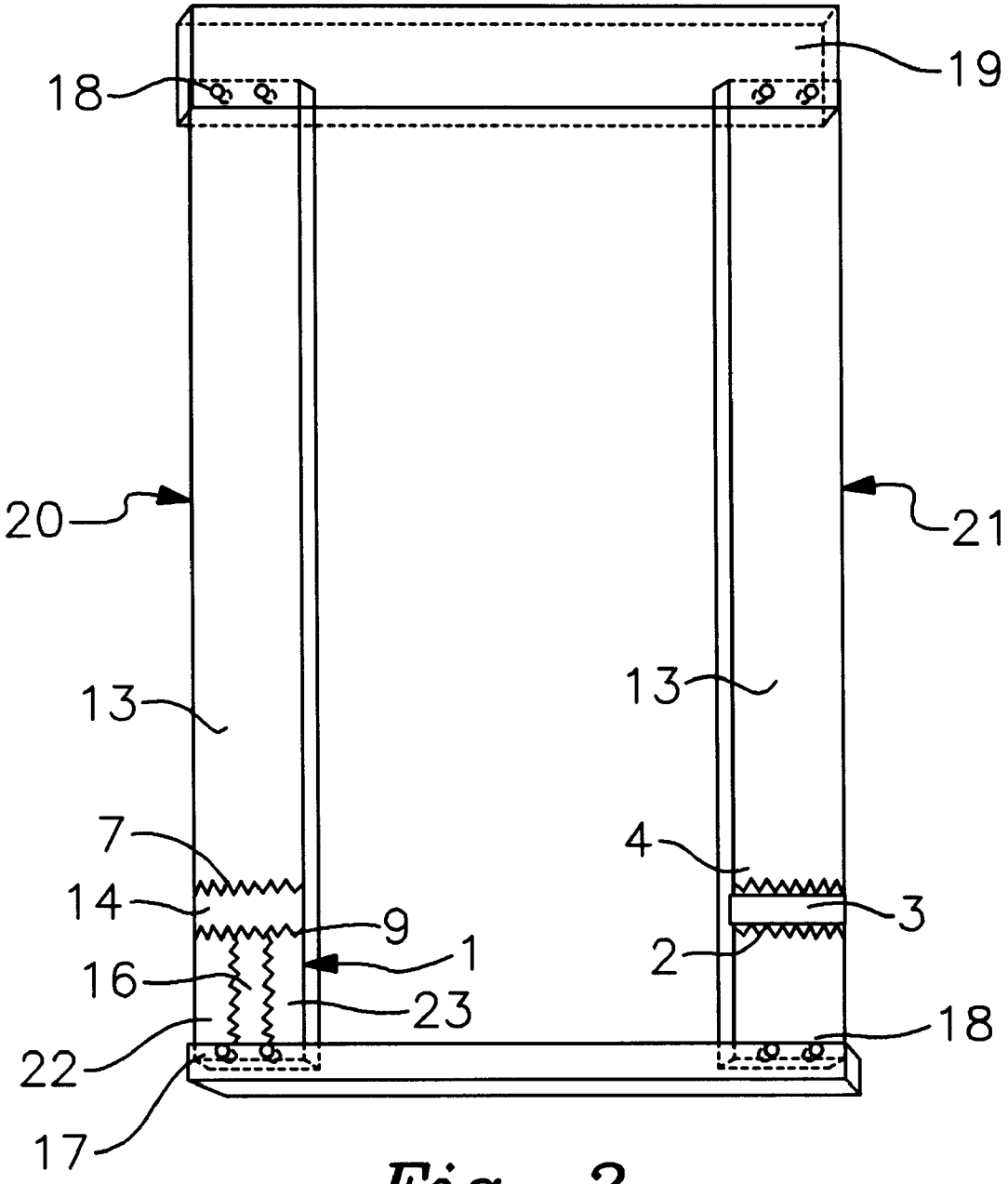
FIG. 2 shows an assembled door frame using timbers such as those shown in FIG. 1.

As shown in FIG. 2 these members can be used door jams or other framing uses, as well as for lumber members which adjoin foundations and need to be treated. However these members can be used in a variety of applications such as round beams made out of a series of adjoined lumber members.

FIG. 2 shows two different methods of incorporating the technology disclosed. The left member 20, typically known as the left jamb, consists of an untreated board length 13, joined by a joined edge 7 to an unbending member, here a horizontal structurally inert solid 14, such as plastic, metal or composite which resists any twisting. First lumber member 1 is supported and maintained by a vertical structurally inert solid 16 which may be mounted on the face of or separate all or part of left first member 22 and right first member 23 and which, in this case, is joined with the horizontally structurally inert solid 14. This may be necessary in order to prevent some or all of the distortion of the treated first lumber member 1 in certain situations. Because this allows for the connection of the distorting treated lumber to an unbending material along a length of the untreated board, and because this length can extend from top to bottom or side to side of the untreated lumber, the pressure caused by the treated lumber distortion is spread to a greater area on the untreated lumber.

Nails or screws 18 can be used to secure the left frame to a baseboard 17 and a top board 19. Because the portions of the first lumber member 1 which are attached by nails or screws 18 to the base board 17 are wood, the attachment is superior to that available using composites because of the ease and longevity of the attachment. Also, the treated lumber used for the first lumber member has significant cost advantages over composites used for similar purposes.

The right member 21, typically known as the right jamb, has the same design as that shown in FIGS. 1*a* and 1*b* without a horizontal or vertical solid support 14 or 16.

Figure 3:
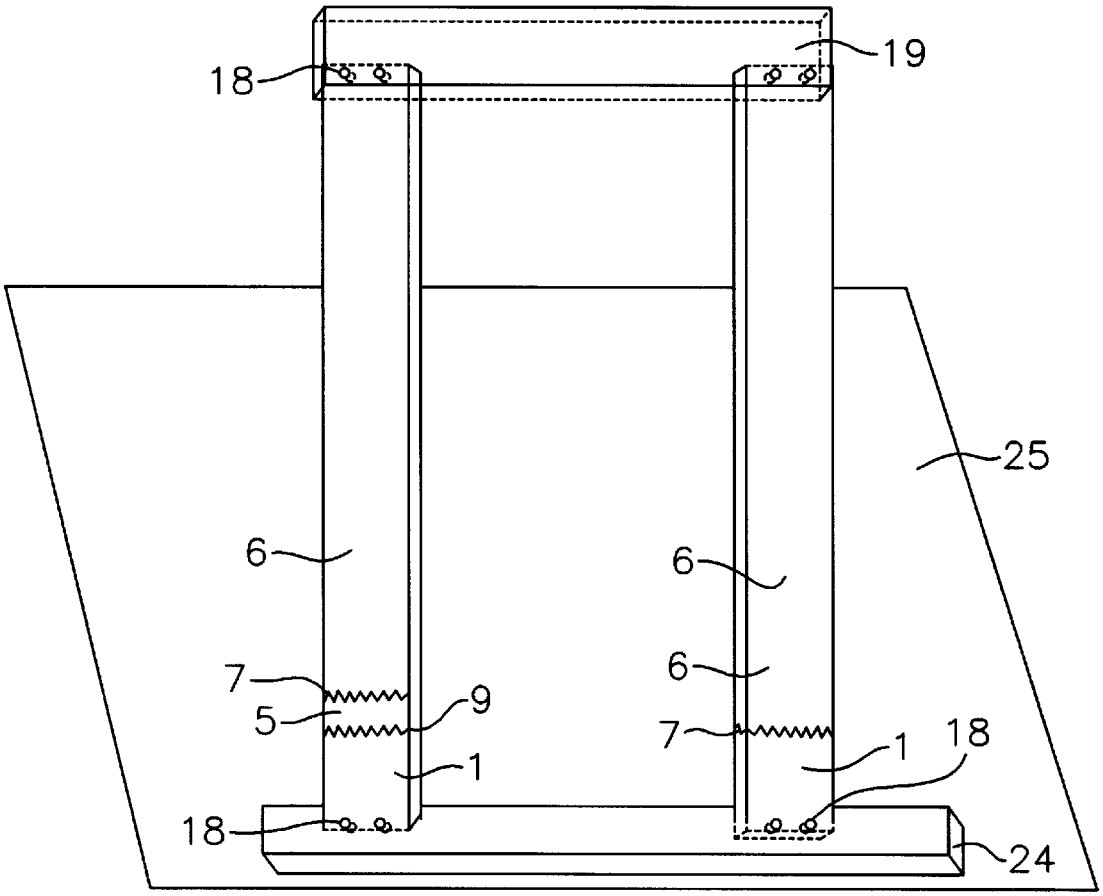
FIG. 3 shows members as shown in FIG. 1 used for framing on a slab.

FIG. 3 shows the same lumber members described in FIG. 1*a*, but here they are mounted directly to a floor framing member 24 which is directly attached to a foundation 25. This is a superior design for a framing combination, because less expensive untreated wood may be used in conjunction with treated members. The treated members 1 are necessary because of moisture and insects which can come from the foundation 25. This is particularly useful when framing onto a concrete slab where the wood adjacent to the slab should be treated.

Treated lumber has the following defects which are not present in untreated lumber: twisting, splitting, warping and bowing. By drying under unique controlled conditions, you can obtain KDAT or kiln dried after treatment lumber which suffers less significantly from twisting, warping, bowing and splitting (defects) and this lumber can be used in the invention. The amount of twisting, warping, bowing and splitting of treated lumber is a function of length. The longer the lumber, the greater the defects. Because the treated lumber portion has to have an attachable location, it is typically at least two inches in length to thirty six inches in length. Typically, in order to maximize the amount of separation for the treated portion from environmental pressures, the treated portion, the first member 1 is at least four inches. In the preferred embodiment, in order to minimize the amount of warp and provide acceptable separation from environmental pressures the first member 1 is twelve inches.

Since the length of the treated lumber effects its usability its preferably approximately twelve inches in length typically at least thirty inches in order to raise the level above where water would be expected to effect the wood and it is typically less than four feet since anything above four feet is too likely to warp, twist, bow and split in order to be usable.

In order to extend the length the invention, shown in FIG. 1 can be fitted with bracing or reinforced by bracing made out of composite materials.

In addition the several lengths of treated lumber may be joined together with composites in order to obtain a product with less of a tendency to bend and it would be covered in this invention as long as at least one of the lower portions between layers of composite was made out of a treated lumber material.

As shown in FIG. 2 the invention when assembled into a frame comprises a overhead, a left door jam, a right door jam and a treated or synthetic and non-sliding bottom portion.

What is claimed is:

1. A frame member for improved moisture decay and insect resistance generally known as environmental pressures for erection over the earth comprising;

a) a first treated lumber member having a top end and a bottom end and wherein the bottom end is closer to the earth when erected, b) a first untreated lumber member having a upper end and a lower end, said lower end being joined to the top end of the first treated lumber member and further comprising;

a) a top board having a left side and a right side, said left side attached to the upper end of the first untreated lumber member;

b) a bottom board having a left side and a right side said left side attached to the bottom end of the first treated lumber member;

c) a second frame member comprising;

i) a second treated lumber member having a top end and a bottom end and wherein the bottom end is closer to the earth when erected;

ii) a second untreated lumber member having a upper end and a lower end, said lower end being joined to the top end of the second treated lumber member; and wherein the second treated member bottom end is attached to the right side of the bottom board and wherein the second untreated lumber member upper end is attached to the right side of the top board to form a frame.

2. The frame member of claim 1 wherein the first and second treated lumber members are further described as having a length between four inches and thirty six inches.

3. The invention of claim 1 wherein each untreated lumber member is at least three times the length of each treated lumber member.

4. The invention of claim 1 wherein the bottom board further comprises a framing unit adjacent to the foundation of a house.

5. The invention of claim 1 wherein the treated lumber member and untreated lumber member are joined utilizing permanent glue.

6. The invention of claim 5 wherein the permanent glue is waterproof glue.

* * * * *